US006578722B2

(12) United States Patent
Perkins et al.

(10) Patent No.: US 6,578,722 B2
(45) Date of Patent: Jun. 17, 2003

(54) PORTABLE HOIST ASSEMBLY

(76) Inventors: Scott Perkins, 3348 Highway 158 West, Douglas, GA (US) 35135; Don Hamilton, 968 Carver Rd., Douglas, GA (US) 35125

( * ) Notice: Subject to any disclaimer, the term of this patent is extended or adjusted under 35 U.S.C. 154(b) by 0 days.

(21) Appl. No.: 09/893,930

(22) Filed: Jun. 29, 2001

(65) Prior Publication Data

US 2003/0000906 A1 Jan. 2, 2003

(51) Int. Cl.[7] ..... B66C 23/44
(52) U.S. Cl. ..... 212/180; 212/294; 414/462
(58) Field of Search ..... 414/462; 212/179, 212/180, 901, 294

(56) References Cited

U.S. PATENT DOCUMENTS

| | | | | | |
|---|---|---|---|---|---|
| 2,305,202 | A | * | 12/1942 | Smith | 212/179 |
| 3,139,203 | A | * | 6/1964 | Borger | 414/462 |
| 3,301,421 | A | * | 1/1967 | Lutters | 414/462 |
| 3,326,391 | A | * | 6/1967 | Adolfsson | 212/55 |
| 4,150,754 | A | * | 4/1979 | Schmitt | 212/8 R |
| 4,419,038 | A | * | 12/1983 | Pendergraft | 414/543 |
| 4,881,864 | A | | 11/1989 | Amato | |
| 5,211,297 | A | * | 5/1993 | Vandervalk | 212/231 |
| 5,341,898 | A | * | 8/1994 | Baziuk | 182/142 |
| 5,540,537 | A | * | 7/1996 | Welch | 414/462 |
| D374,208 | S | | 10/1996 | Eva, Jr. | |
| D376,885 | S | | 12/1996 | Carey et al. | |
| 5,588,907 | A | | 12/1996 | DePietro et al. | |
| 5,597,081 | A | * | 1/1997 | Shirley | 212/299 |
| 5,682,630 | A | * | 11/1997 | Simon | 5/87.1 |
| 5,725,112 | A | * | 3/1998 | Thorby | 212/180 |
| 5,758,785 | A | * | 6/1998 | Spinosa et al. | 212/901 |
| 5,788,095 | A | | 8/1998 | Watson | |
| 6,089,431 | A | | 7/2000 | Heyworth | |
| D429,051 | S | | 8/2000 | Porter | |
| 6,095,349 | A | | 8/2000 | O'Meara | |
| 6,109,855 | A | | 8/2000 | Vela-Cuellar | |
| 6,152,675 | A | | 11/2000 | Compton | |
| 6,189,866 | B1 | | 2/2001 | Harkins et al. | |

* cited by examiner

*Primary Examiner*—Thomas J. Brahan
(74) *Attorney, Agent, or Firm*—Robert L. Wolter; Beusse Brownlee Bowdoin & Wolter, P.A.

(57) ABSTRACT

The present invention is for a portable hoist assembly that includes a base member, an upright support member and a boom. A winch and line are attached to the hoist assembly with an engagement member for lifting objects. The base member attaches to a receiving member. The receiving member may be a trailer hitch on a vehicle. The boom and base member pivot with respect to the support member to a collapsed storage position. The boom and base member extend substantially parallel to the support member, and an end of the boom attaches to the base member. The engagement member is inserted within the base member for storage.

5 Claims, 3 Drawing Sheets

PORTABLE HOIST ASSEMBLY

FIELD OF THE INVENTION

This invention relates to hoists or load assemblies. More specifically, the invention pertains to such apparatuses that are portable. In addition, the invention involves hoist assemblies that are used with a trailer hitch of a vehicle.

BACKGROUND OF THE INVENTION

Loading large or heavy objects in commercial or industrial settings is often done with the use of pallets and forklifts or the like. In such settings heavy equipment is available for laborers to lift and move these objects. Oftentimes, individuals are faced with loading large or heavy objects in residential, recreational or agricultural environments. In addition, a person may be in a remote location where lifting equipment is not available. For example, hunters having killed large game such as deer are faced with cleaning and loading the carcass onto a truck or sports utility vehicle. Similarly, a farmer may have a need for lifting large, heavy objects onto a vehicle, but may not have the necessary equipment available at that point in time, or at that particular location.

Accordingly, a need exists for a hoist assembly that is portable in nature but structurally sound to lift objects that an individual may not otherwise be able to handle. In addition, it is beneficial for such an assembly to be adapted for use with a trailer hitch on a vehicle.

SUMMARY OF THE INVENTION

The present invention is for a portable hoist assembly. The hoist assembly includes a base member, support member and boom. A winch assembly is connected to the support member and boom, and an engagement member is attached a line for lifting objects. The base member and boom are pivotally attached to the support member enabling one to collapse the hoist assembly to a storage position. The engagement member is detachable from the line, inserted and secured in the support member, boom or base member for storage.

The base member is inserted into a receiving member. In the case of the hoist assembly with a vehicle, the receiving member takes the form of trailer hitch within which the base member fits. An indicator on the base member identifies that portion of the base member necessary to fit within the receiving member for operation of the hoist assembly. The support member is pivoted to a substantially upright position. The boom is rotated to extend lateral of the support member. A winch assembly is mounted to the support member and line from the winch is threaded through a pulley. An engagement member is attached to a free end of the line for lifting objects.

DETAILED DESCRIPTION OF THE DRAWINGS

Figures 1, 3, 4:
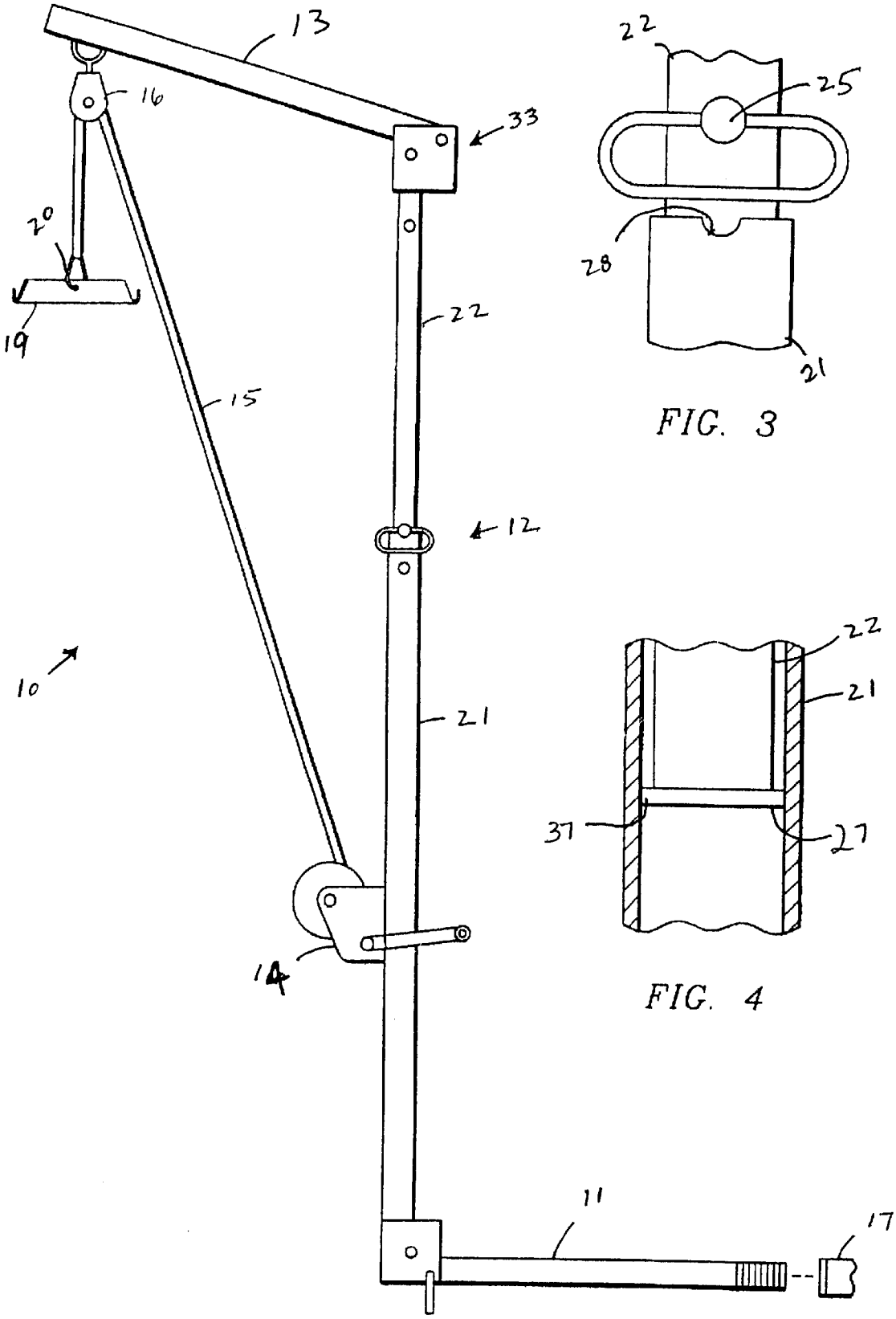
FIG. 1 is a side elevational view of the hoist assembly.
FIG. 3 is an exploded view of the first support member and second member.
FIG. 4 is a sectional side view of the brake on the second support member.

The present invention for a portable hoist assembly 10 is illustrated in FIG. 1 and is shown in use with a vehicle 18 having receiving member 17 as a trailer hitch. However, the hoist assembly 10 is not intended to be limited to use with a motor vehicle, but may be used with any mobile or stationary loading area having an acceptable receiving member 17.

The hoist assembly 10 in FIG. 1 includes a base member 11, support member 12 and boom 13. A winch assembly is attached to the hoist assembly 10 and as shown includes a winch 14 mounted to the support member 12. A line 15, coiled on the winch 14, extends upward through a pulley 16 mounted to the boom 13. An engagement member 19 is attached to the free end of the line 15 by a clip 20. The engagement member 16 illustrated in FIG. 1 is a gambrel having a pair of hooks for engaging objects for lifting. The gambrel may also support straps, lines, cables etc. that may used to engage objects for lifting.

The base member 11 is connected to the receiving member 17. In a preferred embodiment, the base member 11 has an outside diameter that is less than the inside diameter of the receiving member 17. Accordingly, the base member 11 is inserted into the receiving member 17. The receiving member 17 can be of a sufficient length such that fasteners or pins are not required to secure the hoist assembly 10 in place. For example the receiving member of trailer hitch has an inside length of six to seven inches. The base member 11 should by at least that long so sufficient length of the base member 10 is inserted in the receiving member to support the hoist assembly 10 and lifted objects.

The support member 12 and base member 11 are pivotally joined at joint 33 so the two members can be collapsed into a storage position. When the base member 11 is inserted in the receiving member 17, the support member 12 extends in an upright position. In a preferred in embodiment, the support member 12 includes a first support member 21 and a second support member 22 connected in sliding engagement with the first support member 21. The second support member 22 telescopes upward and downward along a longitudinal axis of the first support member 21 to a desired height. A locking pin 25 extends through the second support member 22 and abuts the first support member 21 securing the second support member 22 in place.

As shown in FIG. 3, the locking pin 25 seats within recesses 28 formed in the top edge of the first support member 21. The recesses 28 are aligned with apertures in the second support member 22 through which the locking pin 25 extends. Alternatively, an aperture, below a top edge of the first support member, may be formed for receiving the pin. In either case, the pin 25 seats in the recess 28, or an aperture, and inhibits rotational movement of the second support member 22 within the first support member 21.

Figure 2:
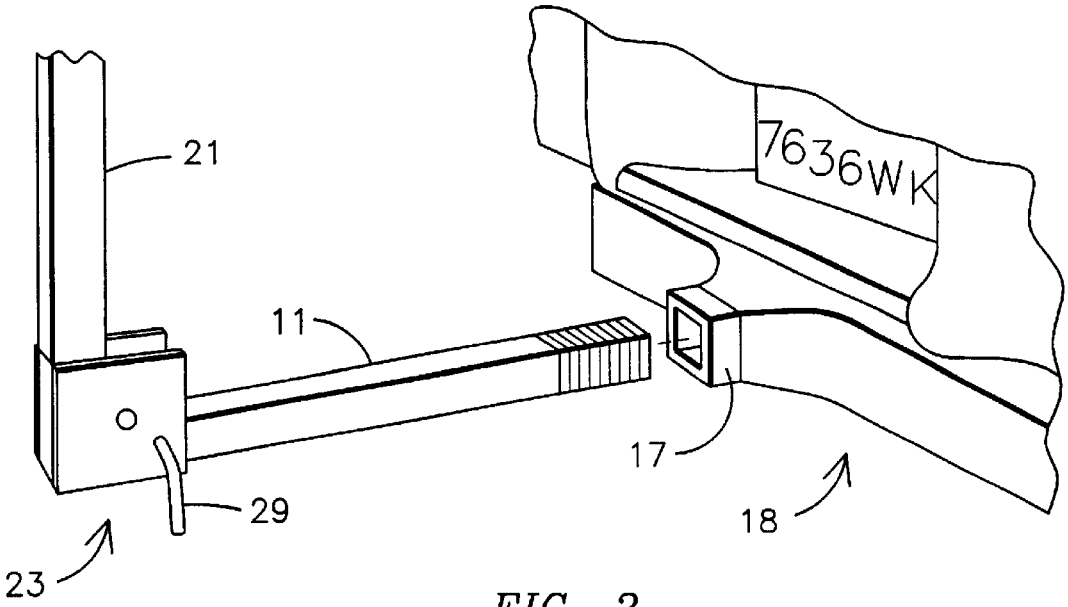
FIG. 2 is a perspective elevational view of the base member and a receiving member.
Figure 5:
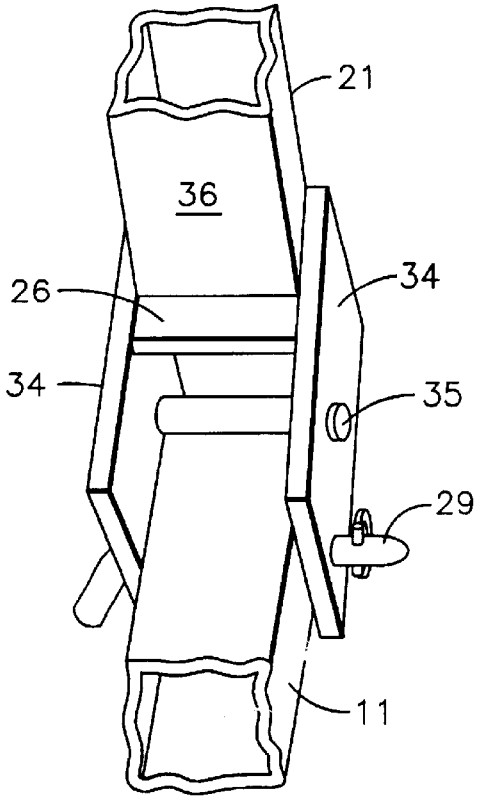
FIG. 5 is a front perspective view of the joint between the first support member and the base member.

With respect to FIGS. 1, 2 and 5, the first support member 21 and base member 11 are coupled at joint 23. When the base member 11 is inserted into the receiving member 17, the support member 12 is rotated to an upright position. A locking pin 29 locks the first support member 21 in an upright position.

The joint 23, and joint 33 referred to below, are conventional joint assemblies known by those skilled in the art. For example, in FIG. 5, the joint 23 simply includes a pair of opposing plates 34 fixed to the first support member 21. Each plate 34 has an aperture. A dowel 35, fixed to the base member 11, extends through the apertures so the plates and dowel 35 pivot with respect to one another, and the base member 11 pivots with respect to the support member 21. A stop 26 attached to the base of the first support member 21, adjacent the joint 23. The stop 26 serves as a safety feature of the hoist assembly. The stop 26 prevents the support member 12 and base member 11 from contacting one another when collapsed, which prevents an operator from smashing or pinching hands and fingers if the first support member 21 is dropped or mishandled. The stop 26, shown in FIG. 5, is a flange section attached to a surface 36 of the first support member 21, and extends substantially perpendicular to the surface 36 of the first support member 21. The stop 26 could also be mounted to the base member 11 perpendicularly to the position shown in FIG. 5. The lock pin 29 extends through aligned apertures in the plates 34 and base member 11 to lock the base member in a substantially perpendicular position with respect to the support member 21.

In the embodiment shown in FIGS. 1 and 4, the first support member 21 has a tubular construction and the second support member 22 telescopes up and down within the first support member 21. A brake 27 is mounted to a bottom end of the second support 22 to control the descent of the second support member 22 within the first support member 21. For example, if an operator is adjusting the height of the second support member 22 and drops the second support member 22, the brake 27 prevents the second support member 22 from quickly dropping in the first support member 21 which could cause injury. The brake 27 is a rubber foot pad that fits snuggly on the bottom end and has a flange portion 37 that has an outside diameter slightly less than the inside diameter of the first support member 21.

The second support member 22 is preferably plugged at its bottom end. In addition, apertures formed in the first support member 21 are usually disposed above the brake 27. In this manner, air is not able to escape to quickly as the second support member 22 drops within the first support member 21. The air trapped beneath brake 27 is compressed, and prevents the brake 27 from quickly dropping. The brake 27 thereby controls the descent of the second support member 22 within the first support member 21.

The boom 13 is coupled to a top end of the second support member 22 at joint 33. The boom 13 and second support member 22 are pivotally connected so the boom 13 can be folded into a storage position. As shown in FIG. 1, the boom 13 extends lateral of the loading area.

Figure 6:
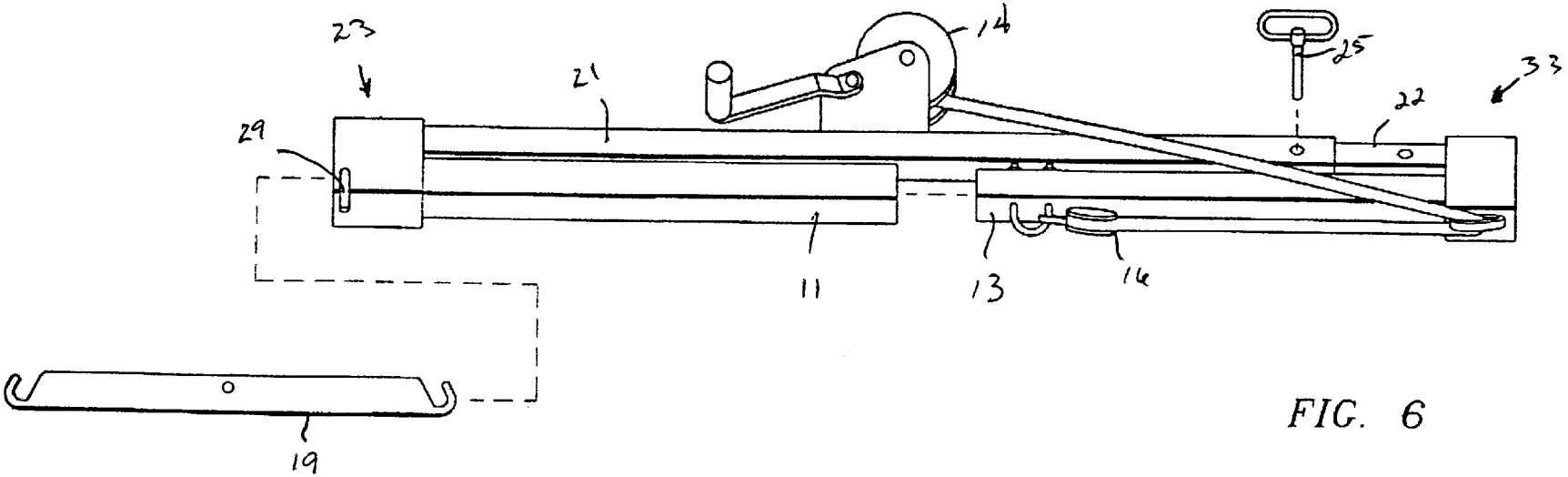
FIG. 6 is a top view of the hoist assembly in a partially collapsed position.
Figure 7:
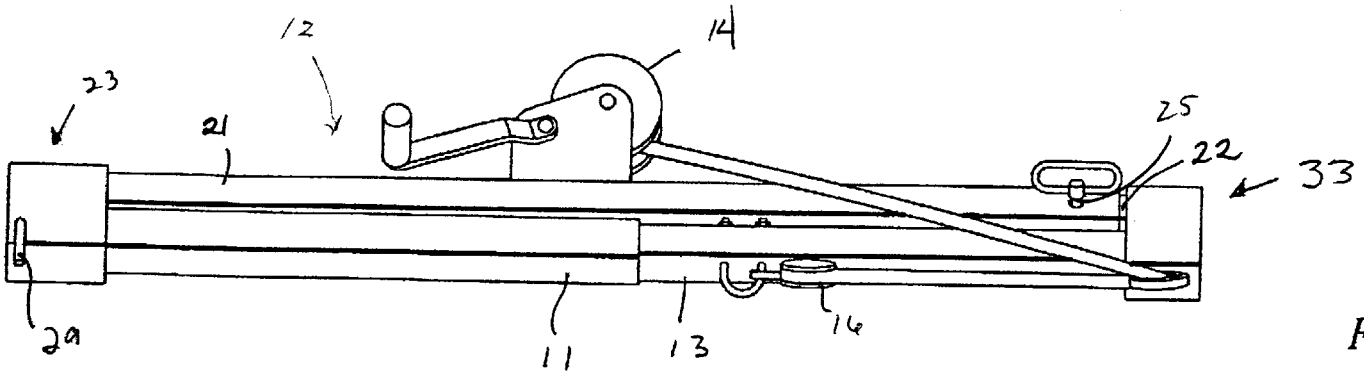
FIG. 7 is a top view of the hoist assembly in a collapsed storage position.

With respect to FIGS. 6 and 7, the hoist assembly 10 is shown collapsed in a storage position. The locking pin 25 supporting the second support member 22 in place is removed, and the second support member 22 telescopes downward in the first support member 21 until the joint 23 abuts the top end of the first support member 21. As the second support member 22 drops within the first support member 21, the brake 27 controls the rate of descent to prevent injury to an operator or damage to the hoist assembly 10.

As shown in FIG. 7, the boom 13 and base member 11 are aligned end-to-end along the same side of the support member 12, opposite the winch 14. When the second support member is fully drawn in the first support member 21, an end portion of the boom 13 fits within the base member 11. The locking pin 25 is inserted through aligned apertures of the first support member 21 and second support member 22 to secure the second support member 22 in its stored position. In this manner, boom 13 is locked within the base member 11. The second support member 22 is unable to slide out of the first support member 21, and approximately 2 to 3 inches of the boom 13 fits within the base member 11. The boom 13 cannot be removed from the base member 11 without first releasing the second support member 22 from the first support member.

Figure 8:
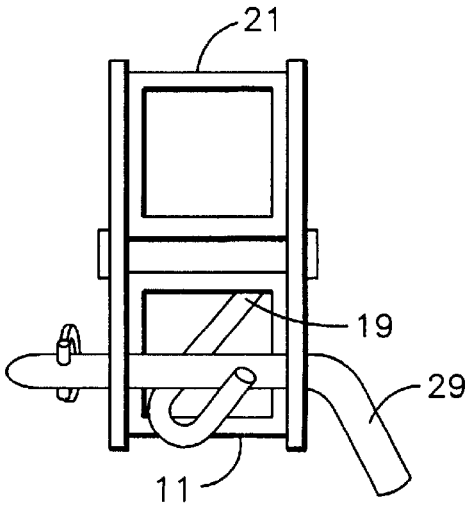
FIG. 8 is an end view of the hoist assembly in a collapsed storage position.

The hoist assembly 10 can then be removed in this reduced position. The base member 11 is then removed from the receiving member 17, and pivoted to its stored position. The engagement member 19 is also removed and inserted into the base member 11. The engagement member 19 shown in the drawings is a gambrel that includes a pair hooks. As shown in FIG. 8, the engagement member 19 extends through an end of the base member and locking pin 29 secures the engagement member 19 within the base member.

While the preferred embodiments of the present invention have been shown and described herein in the context of a portable hoist assembly, it will be obvious that such embodiments are provided by way of example only and not of limitation. Numerous variations, changes and substitutions will occur to those of skilled in the art without departing from the invention herein. Accordingly, it is intended that the invention be limited only by the spirit and scope of the appended claims.

What is claimed is:

1. A portable hoist assembly mountable on a vehicle, comprising:

a. a trailer hitch mounted on a vehicle;

b. a base member coupled with said trailer hitch and extending horizontally therefrom and substantially aligned with a longitudinal axis of the trailer hitch;

c. a support member coupled to the base member in a substantially vertical position, and pivotal with respect to the base member to collapse the hoist assembly to a storage position when the base member is detached from the trailer hitch;

d. a winch assembly, having a line thereon, connected to the support member; and, e. an engagement member connected to the line and winch assembly and said engagement member capable of fitting within said base member or support member when said hoist assembly is in a storage position.

2. The portable hoist assembly of claim 1 further including a boom coupled to a top end of the support member, said boom is pivotal with respect to the support member.

3. The portable hoist assembly of claim 2 wherein said boom and base member are pivoted to a storage position wherein said boom and base member extend substantially parallel to the support member and said boom having an end inserted in said base member and said engagement member is inserted within said base member.

4. A portable hoist assembly that is removably coupled to a trailer hitch for a vehicle, said assembly comprising:

a) a base member having a first end removably coupled to the trailer hitch and extending substantially horizontally therefrom, and substantially aligned with a longitudinal axis of the trailer hitch;

b) a support member having a top end and a bottom end, and said bottom end connected to said base member and extending substantially vertically upward therefrom;

c) a boom coupled to the top end of support member and extending therefrom having a free end distal the support member;

d) a winch assembly mounted to the support member and having a line connected to the boom;

e) an engagement member connected to said line;

f) said base member and said boom member having a substantially tubular configuration; and g) a storage position for the hoist assembly, having been detached from the trailer hitch, wherein said base member, support member and boom member are pivotal with respect to one another and collapsed in said storage position with said boom member and base member extending along a same side of the support member and substantially parallel therewith whereby the free end of the boom and the first end of the base are placed in mating relation with each other.

5. The portable assembly of claim 4 wherein said engagement member is inserted into said base member or said boom member when the assembly is placed in said storage position.

* * * * *